US008213623B2

(12) United States Patent
Faller

(10) Patent No.: US 8,213,623 B2
(45) Date of Patent: Jul. 3, 2012

(54) METHOD TO GENERATE AN OUTPUT AUDIO SIGNAL FROM TWO OR MORE INPUT AUDIO SIGNALS

(75) Inventor: Christof Faller, Chavannes-près-Renens (CH)

(73) Assignee: Illusonic GmbH, Uster (CH)

( * ) Notice: Subject to any disclaimer, the term of this patent is extended or adjusted under 35 U.S.C. 154(b) by 1574 days.

(21) Appl. No.: 11/652,614

(22) Filed: Jan. 12, 2007

(65) Prior Publication Data

US 2008/0170718 A1 Jul. 17, 2008

(51) Int. Cl.
*H04R 5/00* (2006.01)
*H04R 3/00* (2006.01)

(52) U.S. Cl. ..... 381/26; 381/92

(58) Field of Classification Search ..... 381/26, 381/92, 122

See application file for complete search history.

(56) References Cited

U.S. PATENT DOCUMENTS 6,173,059 B1 * 1/2001 Huang et al. ..... 381/92
7,274,794 B1 * 9/2007 Rasmussen ..... 381/92
7,787,638 B2 * 8/2010 Lokki et al. ..... 381/92
2007/0154031 A1 * 7/2007 Avendano et al. ..... 381/92
2008/0260175 A1 * 10/2008 Elko ..... 381/73.1

* cited by examiner

*Primary Examiner* — Vivian Chin
*Assistant Examiner* — Kile Blair
(74) *Attorney, Agent, or Firm* — Harness, Dickey & Pierce, P.L.C.

(57) ABSTRACT

The directionality of microphones is often not high enough, resulting in compromised music recording. Beamforming for getting a signal with a higher directional response is limited due to spatial aliasing, dependence of beamwidth on frequency, and a requirement of a high number of microphones. The invention proposes a method to generate an output audio signal y from two or more input audio signals (x1, x2, . . . ), this method comprising the steps of:

define one input signal as reference signal for each of the other input signals compute gain factors related to how much of the input signal is contained in the reference signal adjust the gain factors using a limiting function compute the output signal by subtracting from the reference signal the other input signals multiplied by the corresponding adjusted gain factors.

18 Claims, 5 Drawing Sheets

METHOD TO GENERATE AN OUTPUT AUDIO SIGNAL FROM TWO OR MORE INPUT AUDIO SIGNALS

INTRODUCTION

The invention relates to microphones and directional responses of microphones. A plurality of microphone signals, or other signals with associated directional response, are processed to overcome the limitation of low directionality of microphones.

BACKGROUND ART

Many techniques for stereo recording have been proposed. The original stereo recording technique, proposed by Blumlein in the 1930's, uses two dipole (figure of eight) microphones pointing towards directions +−45 degrees relative to the forward direction. Blumlein proposed the use of "coincident" microphones, that is, ideally the two microphones are placed at the same point. In practice, coincident microphone techniques place the microphones as closely together as practically possible, i.e. within a few centimeters.

Alternatively, one can use a coincident pair of microphones with other directionality for stereo recording, such as two cardioid microphones. Two cardioids have the advantage that sound arriving from the rear is attenuated (such as undesired noise from an audience).

Coincident microphone techniques translate direction of arrival of sound into a level difference between the left and right microphone signal. Thus, when played back over a stereo sound system, a listener will perceive a phantom source at a position related to the original direction of arrival of sound at the microphones.

Due to the limited directionality of most microphones, the responses often overlap more than desired, resulting in a recorded stereo signal with the left and right channel more correlated than desired. Diffuse sound results in left and right microphone signals which are more correlated than desired, having the effect of a lack of ambience in the stereo signal.

For multi-channel surround recording, this. problem of more than desired overlap of the responses is much more severe due to the necessity of using more microphones (with the same wide responses). There is not only a lack of ambience in the recorded surround signal, but also localization is poor, due to the high degree of cross-talk between the signals.

To circumvent the problem of too highly correlated signals, stereo and surround signals are often recorded using spaced microphones. That is, the microphones are not placed very close to each other, but at a certain distance. Commonly used distances between microphones are between 10 centimeters up to several meters. In this case, sound arriving from different directions is picked up with a delay. between the various microphones. If omnidirectional microphones are used, there is a delay and sound is picked at with a similar level by the various microphones. Often directional microphones are used, resulting in level differences and delays as a function of direction of arrival of sound. This technique is often denoted AB technique and can be viewed as a compromise between coincident and spaced microphone techniques.

For achieving a compromise-free stereo or surround recording, one would need coincident or nearly coincident microphones with a directionality higher than conventional first order microphones. The high directionality will improve perceived localization, ambience, and space when listening to the recording. In summary, one of the most important limitations of stereo and surround sound recording is, that highly directional microphones suitable for music recording are not available.

More directional second or higher order microphones have been proposed but are hardly used in professional music recording due to the fact. that they have lower signal to noise ratio and lower signal quality.

An alternative for getting a high directionality is the use of microphone arrays and the application of beamforming techniques. Beamforming has a number of limitations which have prevented its use in music recording. Beamforming is by its nature a narrow band technique and there is a dependency between frequency and beamwidth. In music recording, at least a frequency range between 20 Hz and 20000 Hz is used. It is very difficult to build a beamformer with a relatively frequency invariant beamshape over this large frequency range. Further, an array with many microphones would be needed for achieving good directionality over a wide frequency range.

While adaptive beamforming effectively improves directionality for a given number of microphones, it is not suitable for stereo or surround recording because it does have a time-variant beamshape, and thus is not suitable for translating direction of arrival of sound into level differences, as is needed for good localization.

SUMMARY OF THE INVENTION

The directionality of microphones is often not high enough, resulting in compromised music recording. Beamforming for getting a signal with a higher directional response is limited due to spatial aliasing, dependence of beamwidth on frequency, and a requirement of a high number of microphones. Adaptive beamforming is suitable for applications where the only aim is to optimize signal to noise ratio, but not suitable for applications where a time-invariant beamshape is required. The invention addresses these limitations, using adaptive signal processing applied to a plurality of microphone signals or other signals with an associated directionality.

A method is therefore proposed to generate an output audio signal y from two or more input audio signals (x1, x2, . . . ), this method comprising the steps of:

define one input signal as reference signal for each of the other input signals compute gain factors related to how much of the input signal is contained in the reference signal adjust the gain factors using a limiting function compute the output signal by subtracting from the reference signal the other input signals multiplied by the corresponding adjusted gain factors The invention proposes a technique for processing of at least two microphone input signals, or other signals with an associated directional response, in order to obtain a signal with a different directional response than the input signals. The goal is to improve directionality, in order to enable improved stereo or surround recording using coincident or nearly coincident microphones. Another application of the invention is to use it as an alternative to conventional beamforming.

BRIEF DESCRIPTION OF THE DRAWINGS

The invention will be better understood thanks to the drawings in which.

Figure 4:
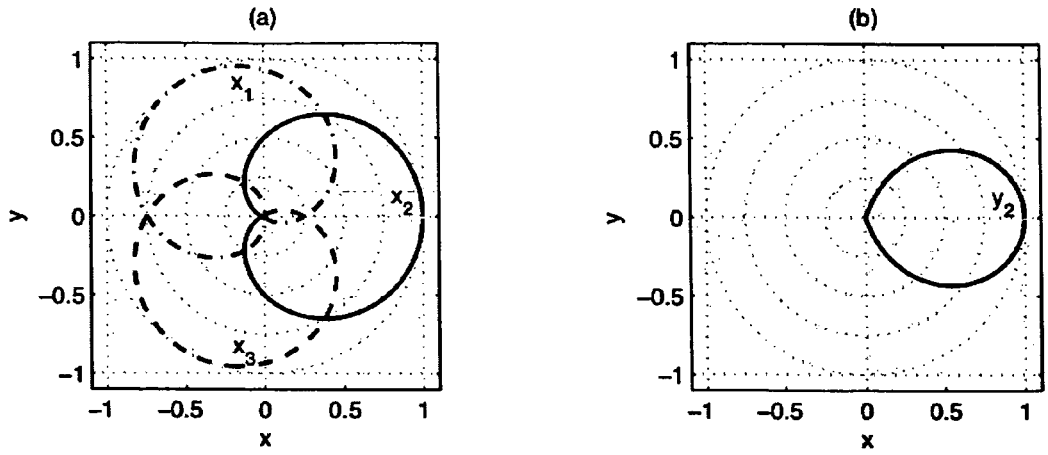

Part (a) of FIG. 4 shows the cardioid responses of three input audio signals, and Part (b) shows the directional response of a processed output audio signal.

Figure 5:
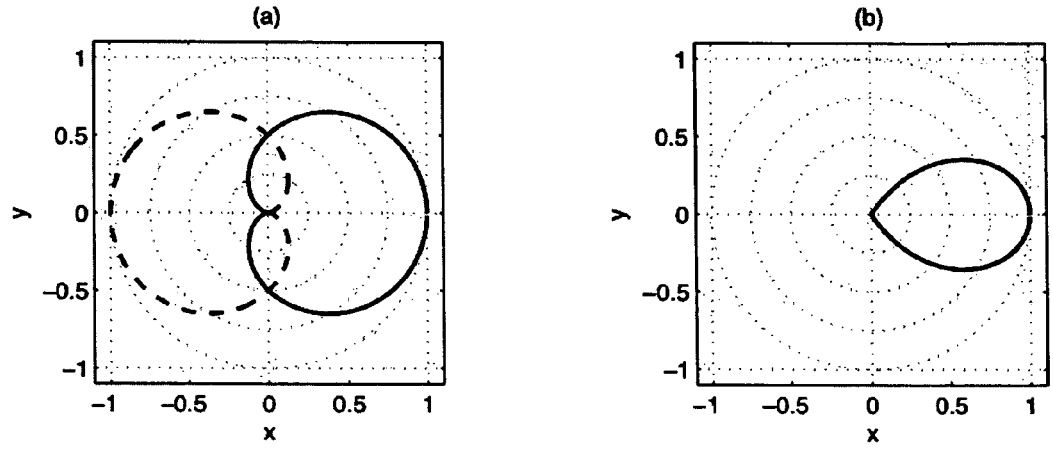

Part (a) of FIG. 5 shows the cardioid responses of two input audio signals, and Part (b) shows the directional response of a processed output audio signal.

Figure 6:
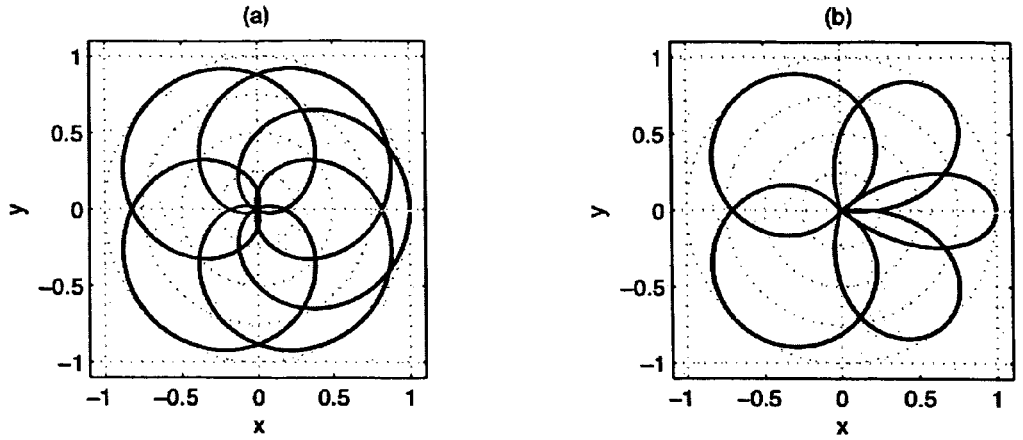

Part (a) of FIG. 6 shows the cardioid responses of five signals, and Part (b) shows the directional responses of five processed output audio signals.

Figure 7:
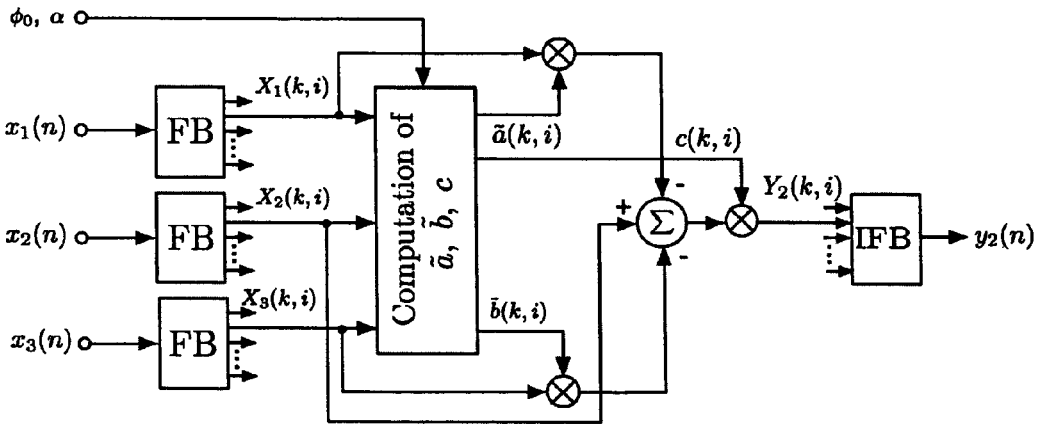

FIG. 7 shows a scheme for processing three input audio signals and to generate a processed output audio signal.

Figure 8:
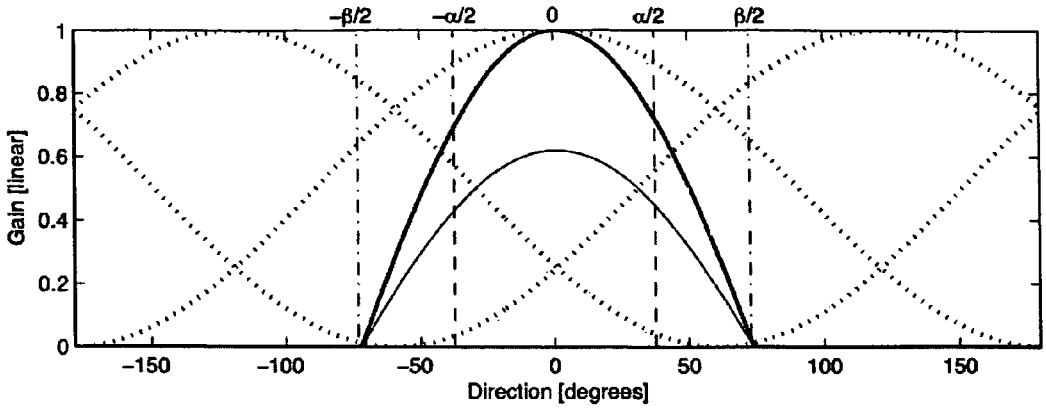

FIG. 8 shows the responses of three input audio signals (dotted) and the response of a processed output audio signal (solid) for direct sound.

Figure 9:
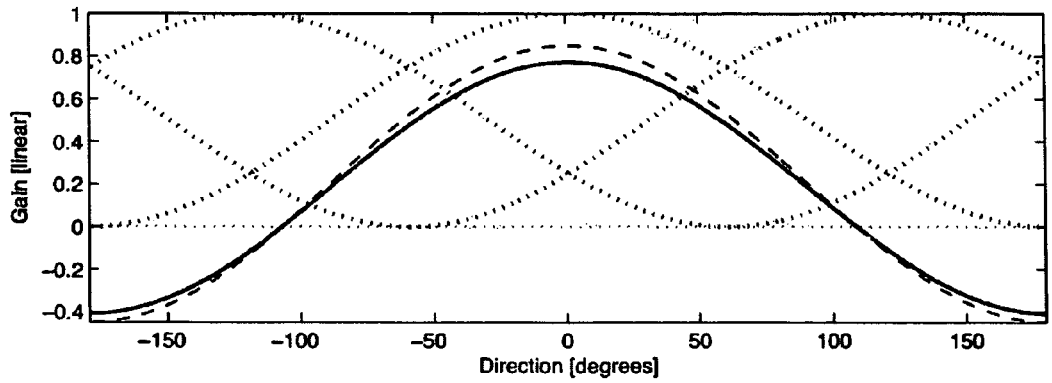

FIG. 9 shows the responses of three input audio signals (dotted) and the response of a processed output audio signal (solid) for diffuse sound.

Figure 10:
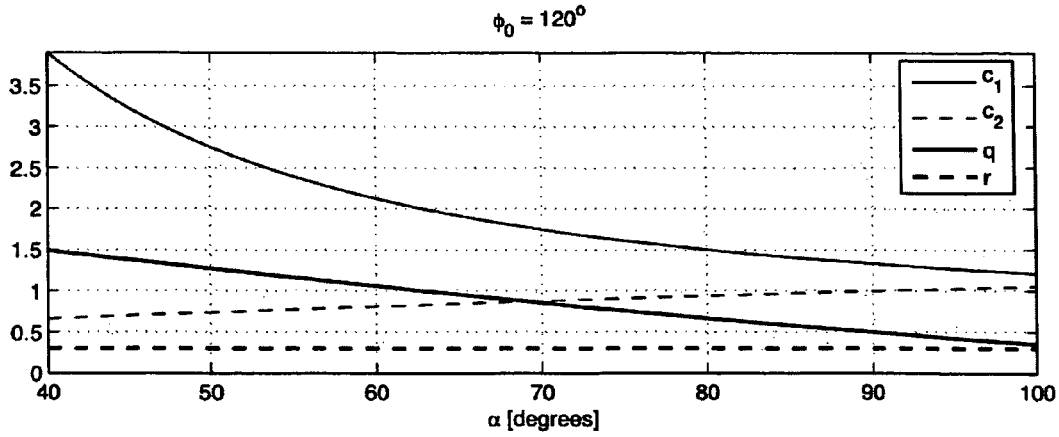

FIG. 10 shows parameters of the proposed processing as a function of the desired width of the directional response of the output signal.

Figure 11:
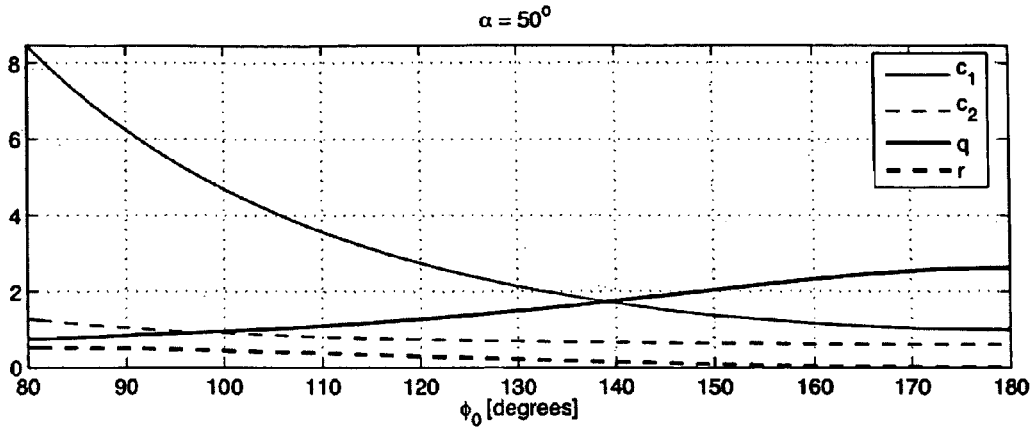

FIG. 11 shows parameters of the proposed processing for a width of the output signal response of 50 degrees as a function of the angle between the responses of the input signals.

DETAILED DESCRIPTION

The detailed description is organized as follows. Section I motivates the proposed scheme and presents a few examples on what it achieves. The proposed processing is described in detail in Section II, using the example of three input signals. The directionality corresponding to the processed output signal for directional sound is derived in Section III. Section IV discusses the corresponding directionality for diffuse sound. Considerations for the case of mixed sound, i.e. directional and diffuse sound, reaching the microphones, are discussed in Section V. Use of the proposed technique for B-Format/Ambisonic decoding is described in Section VI. Section VII discusses different cases than three input signals, the consideration of directional responses in three dimensions, and other generalizations.

I. Motivation and Examples

Figure 1:
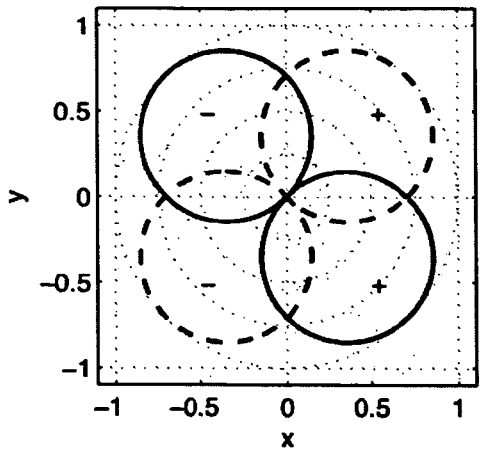
FIG. 1 shows the directional responses of two coincident dipole microphones.

The responses of a coincident pair of dipole microphones, as often used for stereo recording, are illustrated in FIG. 1. This microphone configuration does not feature rejection of rear sound. That is, sound from front and rear is picked up with the same strength. Often it is desired to reject rear sound, for example to reduce noise from an audience during stereo recording.

Figure 2:
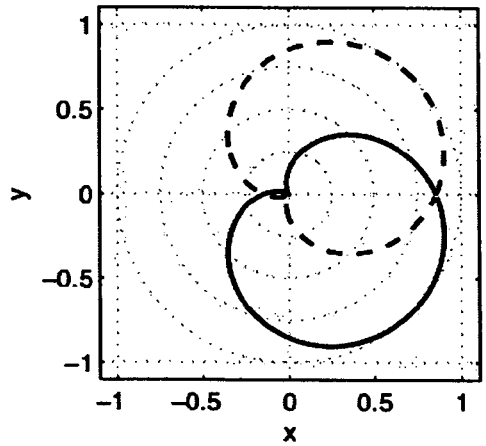
FIG. 2 shows the directional responses of two coincident cardioid microphones.

A coincident pair of cardioid microphones does pick up sound stronger from the front than the rear The responses of such a coincident pair of cardioid microphones, pointing towards +−45 degrees, is illustrated in FIG. 2.

Due to the limited directionality of most microphones, the responses often overlap more than desired, resulting in a recorded stereo signal with the left and right channel more correlated as desired. The two responses shown in FIG. 2 have substantial overlap. The degree of overlap is more than would be desired in many cases. Diffuse sound results in left and right microphone signals which are more correlated than desired, having the effect of a lack of ambience in the stereo signal.

Figure 3:
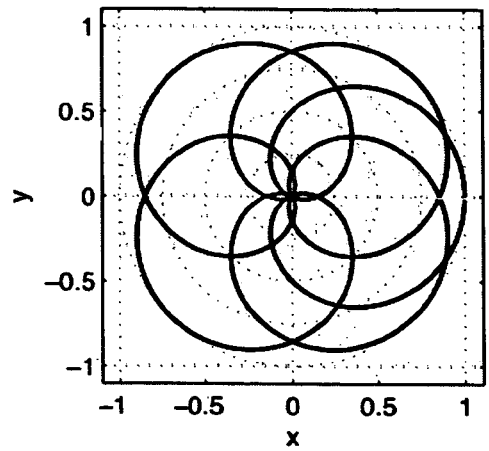
FIG. 3 shows the directional responses of five coincident cardioid microphones.

For multi-channel surround recording, this problem of more than desired overlap of the responses is much more severe due to the necessity of using more microphones (with the same wide responses). FIG. 3 illustrates the responses of five cardioid microphones for recording a five channel. surround audio signal. Note how highly these responses are overlapping. There is not only a lack of ambience in the recorded surround signal, but also localization is poor, due to the high degree of cross-talk between the signals.

The invention addresses the problem of too low directionality of coincident microphones, nearly coincident microphones, or generally any signals with associated directional responses. The invention achieves the following: Given are the signals of at least two microphones, or other signals with an associated directional response. Processing is applied to the input signals, resulting in an output signal with a corresponding directionality which is higher than the directionality of any of the input signals.

The proposed technique is now motivated and explained by means of an example of three given cardioid microphone signals, $x_1(n)$, $x_2(n)$, and $x_3(n)$ with responses as are shown in FIG. 4(*a*). One of the input signals is selected as the signal from which the output signal is derived, for example $x_2(n)$. Given the signal, $x_2(n)$, signal components which are also present in $x_1(n)$ or $x_3(n)$ are eliminated or partially eliminated from $x_2(n)$ when computing the output signal with a corresponding high directionality $y_2(n)$. The degree to which these signal components are eliminated from $x_2(n)$ determines the directionality to which $y_2(n)$ corresponds to. An example of directional response of the output signal $y_2(n)$ is shown in FIG. 4(*b*).

Note that physically it is impossible to obtain a highly directional response, as it is aimed for, which is sound field independent. However, it is shown that for directional sound such a response can be achieved, while for diffuse sound the response is not as highly directional. Diffuse sound is picked up with the correct power but with a different response. The different response is irrelevant for many audio applications. Since diffuse sound is not localizable, high directionality for diffuse sound is not important.

Another example with two input signals is illustrated in FIG. 5. FIG. 5(*a*) illustrates the cardioid responses of the two given signals. An example of a response of a processed output signal is illustrated in FIG. 5(*b*). Note that also in this example the output signal has a much higher directionality than either input signal.

An example for application of the proposed technique for surround recording is illustrated in FIG. 6. FIG. 6(*a*) illustrates the cardioid responses of five microphone signals for recording a multi-channel surround sound signal. Note how the responses are highly overlapping, resulting in a surround sound signal with audio channels which are more correlated than desired. The effect of this is poor localization, coloration, and poor ambience when listening to this surround sound signal. It will be described later in this description how the proposed processing can achieve responses for surround recording as are illustrated in FIG. 6(*b*). These responses only overlap as much as necessary, resulting in a surround sound signal with good localization and ambience. One way of obtaining the input signals for generating the processed output signal for each beam in FIG. 6(*b*), is, by means of processing a B-Format signal as will be described later. Alternatively, the input signals for the proposed processing can also be obtained by combining the signals of a microphone array.

II. The Proposed Processing

The proposed technique is discussed in detail for the case of three input signals. It is clear to an expert in the field, that the same derivations and processing can in a straight forward manner be applied to any case with two or more input signals.

The proposed scheme adapts to signal statistics as a function of time and frequency. Therefore a time-frequency representation is used. A suitable choice for such a time-frequency representation is a filterbank, short-time Fourier transform, or lappned transform. Subband signals may be. combined in order to mimic the spectral resolution of the human auditory system. The time-frequency representation is chosen such that the signals are approximately stationary in each time-frequency tile. Given a signal x(n), its time-frequency representation is denoted X(k,i), where k is the (usually downsampled) time index and i is the frequency (or subband) index.

One of the input signals is selected as the signal from which the output signal is derived. The selected signal is denoted $X_2(k,i)$. We are assuming that the microphone signal $X_2(k,i)$ can be written as $$X_2(k,i)=a(k,i)X_1(k,i)+b(k,i)X_3(k,i)+N_2(k,i), \tag{1}$$

where a(k,i) and b(k,i) are time and frequency dependent real or complex gain factors relating to the cross-talk between signal pairs $\{X_1(k,i), X_2(k,i)\}$ and $\{X_3(k,i), X_2(k,i)\}$, respectively. It is assumed that all signals are zero mean and that $X_1(k,i)$ and $N_2(k,i)$, and, $X_3(k,i)$ and $N_2(k,i)$. are independent, respectively. Note that $X_1(k,i)$ and $X_3(k,i)$ are not assumed to be independent.

The basic motivation of the proposed algorithm is to improve directionality by eliminating or partially eliminating the signal components in $X_2(k,i)$ which are correlated with $X_1(k,i)$ or $X_3(k,i)$:

$$Y_2(k,i)=c(k,i)(X_2(k,i)-\tilde{a}(k,i)X_1-\tilde{b}(k,i)X_3(k,i)) \tag{2}$$

Note that if the weights are chosen to be c(k,i)=1, $\tilde{a}(k,i)=a(k,i)$ and $\tilde{b}(k,i)=b(k,i)$, then $N_2(k,i)$ is recovered. If the weights are chosen $\tilde{a}(k,i)<a(k,i)$ or $\tilde{b}(k,i)<b(k,i)$ then some signal components correlated with $X_1(k,i)$ or $X_3(k,i)$ remain in $N_2(k,i)$. As will be shown later, $\tilde{a}(k,i)$ and $\tilde{b}(k,i)$ are computed as a function of a(k,i), b(k,i), and the desired beamshape or degree of directionality. The post-scaling factor c(k,i) is used to scale the signal such that the maximum response is 0 dB. For simplicity of notation, in the following we are often ignoring the time and frequency index, k and i, respectively.

To compute a and b the following equation system is used:

$$E\{X_1X_2\}=aE\{X_1^2\}+bE\{X_1X_3\}.$$

$$E\{X_2X_3\}=aE\{X_1X_3\}+bE\{X_3^2\} \tag{3}$$

where E{.} is a short time averaging operation for estimating a mean in a time-frequency tile. The equation system (3) solved for a and b yields $$a=\frac{E\{X_1X_2\}E\{X_3^2\}-E\{X_1X_3\}E\{X_2X_3\}}{E\{X_1^2\}E\{X_3^2\}-E\{X_1X_3\}^2} \tag{4}$$

$$b=\frac{E\{X_1^2\}E\{X_2X_3\}-E\{X_1X_2\}E\{X_1X_3\}}{E\{X_1^2\}E\{X_3^2\}-E\{X_1X_3\}^2}.$$

$$a=\sqrt{\frac{E\{X_2^2\}}{E\{X_1^2\}}}\frac{\Phi_{12}-\Phi_{13}\Phi_{23}}{1-\Phi_{13}^2} \tag{5}$$

$$b=\sqrt{\frac{E\{X_2^2\}}{E\{X_3^2\}}}\frac{\Phi_{23}-\Phi_{12}\Phi_{13}}{1-\Phi_{13}^2},$$

This can be written as $$a=\sqrt{\frac{E\{X_2^2\}}{E\{X_1^2\}}}\frac{\Phi_{12}-\Phi_{13}\Phi_{23}}{1-\Phi_{13}^2} \tag{5}$$

$$b=\sqrt{\frac{E\{X_2^2\}}{E\{X_3^2\}}}\frac{\Phi_{23}-\Phi_{12}\Phi_{13}}{1-\Phi_{13}^2},$$

where $\Phi_{ij}$ is the normalized cross-correlation coefficient between $X_i$ and $X_j$, $$\Phi_{ij}=\frac{E\{X_iX_j\}}{\sqrt{E\{X_i^2\}E\{X_j^2\}}}. \tag{6}$$

When $\Phi_{13}$ is equal to one, then (3) is non-unique, i.e. there are infinitely many solutions for a and b. When $\Phi_{13}$ is approximately equal to one, then computation of a and b is ill-conditioned resulting in potentially large errors. One possibility to circumvent these problems, is, to set a and b to $$a=b=\Phi\frac{\sqrt{E\{X_2^2\}}}{\sqrt{E\{X_1^2\}}+\sqrt{E\{X_3^2\}}}, \tag{7}$$

when $\Phi_{13}$ is close to one. We consider $\Phi_{13}$ being close to one for $\Phi_{13}>0.95$. Under the assumption that[1] $\Phi_{12}=\Phi_{23}=\Phi$ this is the non-unique solution of (3) satisfying a=b. In practice when the assumption does not hold perfectly, $\Phi$ is computed as an average of $\Phi_{12}$ and $\Phi_{23}$.

[1]Since $\Phi_{13}=1$, $\Phi_{12}$ and $\Phi_{23}$ are approximately the same.

FIG. 7 summarizes the processing carried out by the proposed scheme. The three given directional microphone signals, $x_1(n)$, $x_2(n)$, and $x_3(n)$ are converted to their corresponding time frequency representations by a filterbank (FB) or time-frequency transform. Further processing is shown for one subband signal. The parameters $\tilde{a}$, $\tilde{b}$, and c are estimated and the subband signal of the highly directional output signal, $Y_2(n)$, is computed. The subbands of the highly directional output signal are converted back to the time domain using an inverse filterbank (IFB) or time-frequency transform, resulting in the highly directional output signal $y_2(n)$.

In the next two sections, the parameters $\tilde{a}$, $\tilde{b}$, and c for a desired directionality are derived for directional and diffuse sound. Then, in Section V computation of $\tilde{a}$, $\tilde{b}$, and c for general scenarios, where directional and diffuse sound is mixed, is explained.

III. Directionality for Directional Sound

If at a specific time and frequency, sound is only arriving from one direction, the three signals $X_1$, $X_2$, and $X_3$ are coherent. Thus, $N_2$ will be zero. To prevent that $Y_2$ is zero, $\tilde{a}$ and $\tilde{b}$ are computed by limiting a and b, $$\tilde{a}=\min\{a,q\}$$

$$\tilde{b}=\min\{b,q\}, \tag{8}$$

where q is the value at which a and b are limited. The directionality corresponding to the so computed $Y_2$ signal can be controlled with parameter q, as is shown in the following. Other limiting functions than min{.} can be used, e.g. as opposed to using a "hard limit" such as the min{.} one may use a function implementing a more soft limit. Use of such a limiting function is. one of the crucial aspects of this invention. A general definition of such a limiting function may be: A function which has an output value which is smaller or equal than its input. Often the limiting function will be a function which is monotonically increasing and once it reaches its maximum it will be constant. The limiting functions applied to a and b, respectively, may be the same as in (8), or it may be different for a and b.

For sound arriving from only one direction, the signals measured by three coincident cardioid microphones, pointing in directions $-\phi_0, 0, \phi_0$ can be written as $$X_1 = \frac{1}{2}(1+\cos(\phi+\phi_0))S \tag{9}$$

$$X_2 = \frac{1}{2}(1+\cos\phi)S$$

$$X_3 = \frac{1}{2}(1+\cos(\phi-\phi_0))S,$$

where S is the short time spectrum of the sound and $\phi$ is the direction from which the sound is arriving. FIG. 4(*a*) shows the directionality pattern of $X_1$, $X_2$, and $X_3$ for $\phi_0=120°$. Without loss of generality, the proposed scheme is derived for cardioid microphones. Note that the proposed scheme can be applied with microphones with other directionalities.

The estimated signal $Y_2$ (2) is equal to $$Y_2 = \frac{c}{2}\left(1-\tilde{a}-\tilde{b}+\cos\phi-\tilde{a}\cos(\phi+\phi_0)-\tilde{b}\cos(\phi-\phi_0)\right)S. \tag{10}$$

This is equivalent to $$Y_2 = \frac{c}{2}\left(1-\tilde{a}-\tilde{b}+\cos\phi\left(1-(\tilde{a}+\tilde{b})\cos\phi_0\right)+\sin\phi\sin\phi_0(\tilde{a}-\tilde{b})\right)S. \tag{11}$$

Thus, $Y_2$ has a directionality pattern of $$d(\phi) = \frac{c}{2}\left(1-\tilde{a}-\tilde{b}+\cos\phi\left(1-(\tilde{a}+\tilde{b})\cos\phi_0\right)-\sin\phi\sin\phi_0(\tilde{a}-\tilde{b})\right). \tag{12}$$

Note that in the considered case of sound arriving from one direction, $X_1, X_2$, and $X_3$ are coherent and $\phi_{13}=1$. Thus in this case, a and b are computed with (7) and a=b. $Y_2$ is zero, except when the gain factors (7) are limited, i.e. a=b>q. Thus the effective directionality pattern is obtained by substituting $\tilde{a}=\tilde{b}=q$ in (12) and lower bounding the directionality by zero, $$d_{Y_2}(\phi) = \max\left\{\frac{c}{2}(1-2q+\cos\phi(1-2q\cos\phi_0)),\ 0\right\}. \tag{13}$$

The width $\alpha$ of the resulting directionality pattern satisfies $$d_{Y_2}\left(\frac{\alpha}{2}\right) = \frac{1}{\sqrt{2}}d_{Y_2}(0), \tag{14}$$

where the width is defined as the size of the range for which the gain is not more attenuated than 3 dB compared to the maximum gain. Combining (13) and (14) yields $$\frac{c}{2}\left(1-2q+\cos\frac{\alpha}{2}(1-2q\cos\phi_0)\right) = \frac{c}{2\sqrt{2}}(2-2q(1+\cos\phi_0)), \tag{15}$$

which, solved for q, is $$q = \frac{\sqrt{2}-1-\cos\frac{\alpha}{2}}{\sqrt{2}-2+\sqrt{2}\cos\phi_0-2\cos\phi_0\cos\frac{\alpha}{2}}. \tag{16}$$

The post-scaling factor c is chosen such that the maximum gain of the resulting response is equal to 1, i.e. $d_{Y_2}=1$. This is the case for $c=c_1$ with $$c_1 = \frac{1}{1-q(1+\cos\phi_0)}. \tag{17}$$

An example for $\phi_0=120°$ and a directionality pattern with width $\alpha=75°$ is shown in FIG. 8. The responses of $X_1$, $X_2$, and $X_3$ are shown as dotted lines. The width of the response of $Y_2$ (13) is indicated with the two dashed vertical lines. The resulting response without post-scaling (c=1) is indicated by the solid thin line. Note that the maximum response, $d_{Y_2}$ (0), is smaller than one in this case. The response after post-scaling with $c=c_1=1.61$ (17) is shown as bold solid line in the figure. The response after post-scaling, in polar coordinates, is also illustrated in FIG. 4(*b*) (solid, bold).

The width of the response was previously defined as the width of range of the response where it is not more than 3 dB attenuated compared to the maximum response. The dash-dotted vertical lines in FIG. 8 indicate the range $\beta$ within which the response is non-zero. Given (13), it can easily be shown that $$\beta = 2\arccos\frac{2q-1}{1-2q\cos\phi_0}. \tag{18}$$

IV. Directionality for Diffuse Sound

As opposed to the case of sound arriving only from one direction, for diffuse sound arriving from all directions, $N_2$ (1) is not zero for this case. For the analysis of this case we are first computing $N_2$, $$N_2(k,i)=X_2(k,i)-a(k,i)X_1(k,i)-b(k,i)X_3(k,i), \tag{19}$$

and then with the insights gained, $\tilde{a}, \tilde{b}$, and c for computation of $Y_2$ are determined.

A. Computation of $N_2$ for Diffuse Sound

It is assumed that diffuse sound can be modeled with plane waves arriving from different directions. Thus, diffuse sound measured by three coincident cardioid microphones, pointing towards $-\phi_0, 0, \phi_0$, can be written as $$X_1(k,i) = \frac{1}{2}\int_{-\pi}^{\pi}(1+\cos(\phi+\phi_0))S(k,i,\phi)d\phi \tag{20}$$

$$X_2(k,i) = \frac{1}{2}\int_{-\pi}^{\pi}(1+\cos(\phi))S(k,i,\phi)d\phi$$

-continued $$X_3(k, i) = \frac{1}{2}\int_{-\pi}^{\pi}(1+\cos(\phi-\phi_0))S(k, i, \phi)d\phi,$$

where $S(k,i,\phi)$ is related to the complex amplitude of a plane wave arriving from direction $\phi$. For the diffuse sound analysis, it is assumed that the power of sound is independent of direction and that the sound arriving from a specific direction is orthogonal to the sound arriving from all other directions, i.e.

$$E\{S(k,i,\phi)S(k,i,\gamma)\}=P\delta(\phi-\gamma), \tag{21}$$

where $\delta(.)$ is the Delta Dirac function.

For obtaining (21) in this case, a and b are computed. For diffuse sound, the signals $X_1$,$X_2$, and $X_3$ are not coherent and $\phi_{13}<1$. Thus, a and b are computed with (4). For this purpose, $E\{X_1^2\}E\{X_2^2\}$,$E\{X_3^2\}E\{X_1X_2\}$,$E\{X_2X_3\}$, and $E\{X_2X_3\}$ are needed. $E\{X_2^2\}$ is equal to $$E\{X_2^2\} = \frac{1}{4}E\left\{\int_{-\pi}^{\pi}(1+\cos(\phi+\phi_0))S(k, i, \phi)d\phi\int_{-\pi}^{\pi}(1+\cos(\gamma+\phi_0))S(k, i, \gamma)d\gamma\right\}. \tag{22}$$

With (21) this can be simplified and solved, $$E\{X_2^2\} = \frac{P}{4}\int_{-\pi}^{\pi}(1+\cos^2\phi)d\phi = \frac{3\pi P}{4}. \tag{23}$$

Due to assumption (21), $E\{X_1^2\}=E\{X_3^2\}=E\{X_2^2\}$.
In a similar fashion $E\{X_1X_2\}$,$E\{X_2X_3\}$, and $E\{X_1X_3\}$ can be computed:

$$E\{X_1X_2\} = E\{X_2X_3\} = \frac{\pi(2+\cos\phi_0)P}{4} \tag{24}$$

$$E\{X_1X_3\} = \frac{\pi(2+\cos(2\phi_0))P}{4}.$$

Substituting (23) and (24) into (4) with a=b=r $$r = \frac{(2+\cos\phi_0)(1-\cos(2\phi_0))}{9-(2+\cos(2\phi_0))}. \tag{25}$$

The corresponding directionality is $$d_{N_2}(\phi) = \frac{c}{2}(1-2r+(1-2r\cos\phi_0)\cos\phi). \tag{26}$$

For example, for $\phi_0=120°$ the weights (25) are a=b=r=0.3. The corresponding directionality (26) is shown as dashed line in FIG. 9. The responses of $X_1$,$X_2$, and $X_3$ are shown as dotted lines.

B. Computation of $Y_2$ for Diffuse Sound

The directionality pattern obtained for the case of sound arriving from one direction (13) is considered to be the desired directionality. Thus, for obtaining Y2 for diffuse sound the previously computed $N_2$ is adjusted such that this signal is more like a signal obtained from diffuse sound picked up by the desired directionality pattern (13).

When no post-scaling is used in (2), i.e. c=1, then $Y_2$ (2) is equal to $N_2$ (19), since a and b are smaller than q for diffuse sound and $\tilde{a}=\tilde{b}=r$ (8). The directionality of the diffuse sound response (26) is different than the desired directionality (13). But in order to match these two different directionalities better, the post-scaling factor c for the diffuse sound case is computed such that the power of the resulting $Y_2$ is the same as the power that would result if the true desired response (13) would pick up the diffuse sound. That is, the post-scaling factor is computed as $c=c_2$ with $$c_2 = \sqrt{\frac{P_{Y_1}}{P_{N_2}}}, \tag{27}$$

where $P_{N_2}$ is the power of $N_2$ for the diffuse sound case and $P_{Y_2}$ is the power of the $Y_2$ signal if the diffuse sound would be picked up by the desired response (13).

From (26) it follows that the signal $N_2$ is $$N_2(k, i) = \frac{1}{2}\int_{-\pi}^{\pi}(1-2r+(1-2r\cos\phi_0)\cos\phi)S(k, i, \phi)d\phi \tag{28}$$

Thus, the power $N_2$,$P_{N_2}$ can be written as $$P_{N_2} = \frac{1}{4}E\left\{\int_{-\pi}^{\pi}(1-2r+(1-2r\cos\phi_0)\cos\phi)S(k, i, \phi)d\phi\int_{-\pi}^{\pi}(1-2r+(1-2r\cos\phi_0)\cos\gamma)S(k, i, \gamma)d\gamma\right\} \tag{29}$$

Considering the assumption about diffuse sound (21), this can be simplified and solved, $$P_{N_2} = \frac{P}{4}\int_{-\pi}^{\pi}((1-2r)^2+(1-2r\cos\phi_0)^2\cos^2\phi)d\phi = \frac{\pi P(2(1-2r)^2+(1-2r\cos\phi_0)^2)}{4}. \tag{30}$$

Applying the desired directionality (13) to diffuse sound yields the signal $$Y_2(k, i) = \frac{c_1}{2}\int_{-\frac{\beta}{2}}^{\frac{\beta}{2}}(1-2q+(1-2q\cos\phi_0)\cos\phi)S(k, i, \phi)d\phi \tag{31}$$

where $\beta$ (13) is the width for which the response is non-zero. The power of $Y_2$, $P_{Y_2}$, can be written as $$P_{Y_2} = \frac{c_1^2}{4}E\left\{\int_{-\frac{\beta}{2}}^{\frac{\beta}{2}}(1-2q+(1-2q\cos\phi_0)\cos\phi)S(k, i, \phi)d\phi\int_{-\frac{\beta}{2}}^{\frac{\beta}{2}}(1-2q+(1-2q\cos\phi_0)\cos\gamma)S(k, i, \gamma)d\gamma\right\} \tag{32}$$

Considering the assumption about diffuse sound (21) this can be simplified and solved, $$P_{Y_2} = \frac{c_1^2 P}{4}\int_{-\frac{\beta}{2}}^{\frac{\beta}{2}}((1-2q)^2+(1-2q\cos\phi_0)^2\cos^2\phi+2(1-2q\cos\phi_0)\cos\phi_0)\,d\phi = \frac{c_1^2 P\beta}{4}(1-2q)^2+\frac{c_1^2 P}{8}(1-2q\cos\phi_0)^2\left(\beta+2\cos\frac{\beta}{2}\sin\frac{\beta}{2}\right)+P(1-2q)(1-2q\cos\phi_0)\sin\frac{\beta}{2}. \tag{33}$$

Thus, for diffuse sound the post-scaling factor (27) is $c=c_2$, where $$c_2 = \sqrt{\frac{A+B+C}{2\pi(2(1-2r)^2+(1-2r\cos\phi_0)^2)}}, \tag{34}$$

with $$A = 2c_1^2\beta(1-2q)^2$$
$$B = c_1^2(1-2q\cos\phi_0)^2\left(\beta+2\cos\frac{\beta}{2}\sin\frac{\beta}{2}\right)$$
$$C = 8(1-2q)(1-2q\cos\phi_0)\sin\frac{\beta}{2}. \tag{35}$$

V. Estimating $Y_2$ in the General Case when there is a Mix of Direct and Diffuse Sound FIG. 10 shows a numerical example of the values $c_1$,$c_2$,q and r as a function of the width of the desired directionality, $\alpha$, for $\phi_0=120°$. As can be seen in the figure, q is always smaller than r. That is, the gain factors a=b=r, estimated when there is diffuse sound, are expected to be smaller than the limit q used for computation of $\tilde{a}$ and $\tilde{b}$ (8). Thus, for diffuse sound $a=\tilde{a}$ and $b=\tilde{b}$ and for both scenarios (8) can be used to compute the final gain factors $\tilde{a}$ and $\tilde{b}$.

The same parameters are shown in FIG. 11 for a fixed width of the directionality, $\alpha=50°$, as a function of the look direction difference $\phi_0$ of the three given microphone responses. Again, r is always smaller than q.

The computation of the parameters $\tilde{a}$,$\tilde{b}$, and c for estimation of $Y_2$ (2) for a general scenario with direct and diffuse sound simultaneously can be as follows. At each time k and frequency i the following algorithm is applied:

1. If $\Phi_{13}\leqq 0.95$ then compute a and b with (4), else compute a and b with (7).
2. Compute $\tilde{a}$ and $\tilde{b}$ (8).
3. Compute the post-scaling factor as $$c = \frac{\max\{\tilde{q}-r,0\}}{q-r}(c_1-c_2)+c_2, \tag{36}$$

where $\tilde{q}$ is an average of $\tilde{a}$ and $\tilde{b}$, e.g. $\tilde{q}=0.5(\tilde{a}+\tilde{b})$. The motivation for (36) is as follows. If there is sound from only one direction, $c_1$ is used as post-scaling factor c. If there is only diffuse sound, $c_2$ is used for post-scaling. When there is a mix between direct and diffuse sound, a value in between $c_2$ and $c_1$ is used for post-scaling.

4. Given $\tilde{a}$,$\tilde{b}$, and c, $Y_2$ is computed with (2).

VI. Ambisonic Decoding

A first order B-Format signal is (ideally) measured in one point and consists of the following signals: w(n) which is proportional to sound pressure and {x(n), y(n), z(n)} which are proportional to the x, y, and z components. of the particle velocity. While w(n) corresponds to the signal of an omni-directional microphone, {x(n), y(n), z(n)} correspond to signals of dipole (figure of eight) microphones pointing in x, y, and z direction.

A signal with a cardioid response in any direction can be computed by linear combination of the B-Format signals:

$$c_{\Gamma,\theta}(n) = \frac{1}{2}\left(w(n)+\frac{1}{\sqrt{2}}x(n)\cos\Gamma\cos\theta+\frac{1}{\sqrt{2}}y(n)\sin\Gamma\cos\theta+\frac{1}{\sqrt{2}}z(n)\sin\theta\right), \tag{37}$$

where the direction of the cardioid is determined by the azimuth and elevation angles, $\Gamma$ and $\theta$. Similarly, also dipole, super-cardioid, or sub-cardioid responses in any direction can be obtained, as is clear to an expert skilled in the field.

The signal with cardioid response, pointing in any direction, can also be obtained directly in the frequency or subband domain:

$$C_{\Gamma,\theta}(i,k) = \frac{1}{2}\left(W(i,k)+\frac{1}{\sqrt{2}}X(i,k)\cos\Gamma\cos\theta+\frac{1}{\sqrt{2}}Y(i,k)\sin\Gamma\cos\theta+\frac{1}{\sqrt{2}}Z(i,k)\sin\theta\right). \tag{38}$$

As explained, given B-Format signals a cardioid signal pointing in any direction can be computed. (Or alternatively a signal with a different response, such as super-cardioid or sub-cardioid). Thus, the proposed scheme can be used for computing an output signal with a highly directional response in any direction. For example, for computing $y_2(n)$ in the direction defined by $\Gamma=\Gamma_0$ and $\theta=0$; these signals may be used as input signals:

$$x_1(n)=c_{\Gamma-\phi_0,0}(n)$$
$$x_2(n)=c_{\Gamma,0}(n)$$
$$x_3(n)=c_{\Gamma+\phi_0,0}(n) \tag{39}$$

By applying the proposed scheme to these signals, a signal with a desired width a of its directional response can be obtained.

An example of so-obtained responses for B-Format to 5-channel surround conversion is shown in FIG. 6(*b*). As desired, these responses have only little overlap and capture the sound with a high directional resolution.

With conventional B-Format processing, using cardioid responses, corresponding responses are shown in 6(*a*). These responses are highly overlapping resulting in loudspeaker signals with far more cross-talk than desired. When playing these signals back the deficiencies are a mono-like perception (lack of ambience), impaired source localization, and coloration. These problems are due to the fact that for diffuse sound the signals are far more coherent than desired, and, for direct sound there is cross-talk across all signals.

Table I shows the parameters corresponding to the responses shown in FIG. 6(*b*). The direction Γ and width α of the responses, q,r,$c_1$, and $c_2$ are shown for each signal, i.e. for left, right, center, rear left, and rear right.

TABLE I

Parameters for the responses shown in FIG. 6(b).

| Parameter | Left | Right | Center | Rear Left | Rear Right |
|---|---|---|---|---|---|
| Γ [degrees] | 50 | 50 | 0 | 130 | 130 |
| α [degrees] | 60 | 60 | 40 | 100 | 100 |
| q | 2.12 | 2.12 | 3.9 | 1.21 | 1.21 |
| r | 0.81 | 0.81 | 0.66 | 0.35 | 0.35 |
| c1 | 1.06 | 1.06 | 1.49 | 0.35 | 0.35 |
| c2 | 0.3 | 0.3 | 0.3 | 0.3 | 0.3 |

VII. Generalizations

For the sake of explaining the proposed technique in a manner that is easily understandable, we have shown the way of deriving and understanding the proposed technique in detail for the case of three input signals and considering microphone responses in two dimensions. This is not a limitation of the proposed technique. Indeed the proposed technique can be applied to at least two or any larger number of input signals.

The case of two input signals is simpler than the case of three input signals. The previously presented derivations can directly be used for the two input signal case by setting $X_1=X_3$.

When more than three input signals are used, or different directional responses of the input signals, there may not anymore be rather. simple solutions for the gain factors and relating the gain factor limit to the width of the response. As is clear to an expert skilled in the field, numerically these values can be computed straight forwardedly for any responses and any number of input signals.

For N input signals, Equation (1) will have N−1 gain factors. In this case, as will be clear to an expert skilled in the field, Equation System (3) will have N−1 equations. Thus, similarly as has been shown for the three input signal case, it is possible to compute the gain factors a, b, . . . .

Considering directional responses in three as opposed to two dimensions does not change the equation in (3) which are used to compute the gain factors a, b, . . . Computation of q and r will be modified when three dimensional responses are considered. It is clear to an expert in the field how to derive q and r in the same manner as has been shown, but for three dimensional responses.

As an expert skilled in the field knows, the gain factors a, b, . . . associated with each input signal other than the reference signal, can be viewed as estimators, estimating the reference signal as a function of the input signals.

VIII. Implementation

The above described method will be suitably implemented in a device embedding an audio processor such as a DSP. This device comprises different software components dedicated to the various tasks performed. This device comprises, in order to generate an output audio signal y from two or more input audio signals (x1, x2, . . . ),:

definition means to define one input signal as reference signal, first calculation means to compute for each of the other input signals the gain factors related to how much of the input signal is contained in the reference signal, adjusting means to adjust the gain factors using a limiting function, second calculation means to compute the output signal by subtracting from the reference signal the other input signals multiplied by the corresponding adjusted gain factors.

The claimed device further comprises a scaling means to scale the output signal after it has been generated by the second calculation means. In a particular embodiment, the limiting function of the adjusting means is determined related to the desired directional response of the output signal.

In case that the calculation is executed in subbands, this device comprises a splitting means to convert the input signal into a plurality of subbands as a function of time, the first calculation computing the gain factors in each subband.

In this later case, in a particular embodiment, the adjusting means uses individual limiting functions for each subband.

IX. Conclusions

The invention proposes a technique for processing a number of input signals, each associated with a directional response, to obtain an output signal with a different directional response. Usually, the output signal is generated such that its response is more directional than the input signals. In principle, the goal can also be to obtain an output signal response to have another property than higher directionality.

The input signals can be coincident or nearly coincident microphone signals, or signals obtained by processing or combining a number of microphone signals.

The invention can also be viewed as a type of adaptive beamforming. The difference to conventional adaptive beamforming is, that the output signal has a time invariant response (for direct sound, or diffuse sound) and thus the proposed scheme is suitable for applications where it is desired that the response shape in itself is not adapted. This is in contrast to conventional adaptive beamforming, where the response is adapted in order to optimize or improve signal to noise ratio.

We successfully tested the proposed scheme for voice acquisition, with one highly directional output signal. Also, we used the proposed scheme for stereo and surround sound recording, with nearly coincident and B-Format input signals.

The invention claimed is:

1. Method to generate an output audio signal y from two or more input audio signals (x1, x2, . . .) using an audio processor, this method comprising the steps of:

defining one input signal as reference signal;

for each of the other input signals, the audio processor computing gain factors related to how much of the input signal is contained in the reference signal;

the audio processor adjusting the gain factors using a limiting function; and the audio processor computing the output signal by subtracting from the reference signal the other input signals multiplied by the corresponding adjusted gain factors.

2. Method of claim 1, wherein the output signal is scaled after it has been generated according to a scaling factor, the scaling factor being based on magnitudes of the gain factors.

3. Method of claim 1, wherein the limiting function is determined related to the desired directional response of the output signal.

4. Method of claim 1, wherein the limiting function is the minimum of the gain factor and a limit value determined related to the desired width of the response of the output signal.

5. The method of claim 1, wherein the processing is carried out in plurality of subbands as a function of time, determining gain factors in each subband.

6. The method of claim 1, wherein the processing is carried out in plurality of subbands and individual limiting functions are chosen for each subband.

7. The method of claim 1, wherein the input signals are microphone signals.

8. The method of claim 1, wherein the input signals are combinations of microphone signals.

9. The method of claim 1, wherein the input signals are combinations of B-Format signals.

10. Method of claim 1, wherein the gain factors have magnitudes which increase as an amount of the input signal that is contained in the reference signal increases.

11. Method of claim 1, wherein the gain factors are computed based on a cross-correlation between the reference signal and the input signals.

12. Device for generating an output audio signal y from two or more input audio signals (x1, x2, . . . ), this device comprising:

definition means to define one input signal as reference signal;

first calculation means to compute for each of the other input signals the gain factors related to how much of the input signal is contained in the reference signal;

adjusting means to adjust the gain factors using a limiting function; and second calculation means to compute the output signal by subtracting from the reference signal the other input signals multiplied by the corresponding adjusted gain factors.

13. Device of claim 12, further comprising:

a scaling means to scale the output signal after it has been generated by the second calculation means according to a scaling factor, the scaling factor being based on magnitudes of the gain factors.

14. Device of claim 12, wherein the limiting function of the adjusting means is determined related to the desired directional response of the output signal.

15. Device of claim 12, further comprising:

a splitting means to convert the input signal into a plurality of subbands as a function of time, the first calculation computing the gain factors in each subband.

16. Device of claim 12, further comprising:

a splitting means to convert the input signal into a plurality of subbands as a function of time, the adjusting means using individual limiting functions for each subband.

17. Device of claim 12, wherein the gain factors have magnitudes which increase as an amount of the input signal that is contained in the reference signal increases.

18. Device of claim 12, wherein the gain factors are computed based on a cross-correlation between the reference signal and the input signals.

* * * * *